US007443769B2

(12) United States Patent
Goeller

(10) Patent No.: US 7,443,769 B2
(45) Date of Patent: Oct. 28, 2008

(54) TIMEPIECE WITH A STRIKING WORK INCLUDING DUAL FUNCTION LOCKING LEVER

(75) Inventor: Eric Goeller, Les Hopitaux Vieux (FR)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 11/951,510

(22) Filed: Dec. 6, 2007

(65) Prior Publication Data

US 2008/0144449 A1 Jun. 19, 2008

(30) Foreign Application Priority Data

Dec. 13, 2006 (EP) ..... 06126041

(51) Int. Cl.
*G04B 21/02* (2006.01)
*G04B 27/02* (2006.01)
*G04B 19/00* (2006.01)
*G04B 21/00* (2006.01)

(52) U.S. Cl. ..... 368/275; 368/75; 368/190; 368/269

(58) Field of Classification Search ..... 368/75, 368/190–195, 243, 246, 257, 260, 265–271, 368/275

See application file for complete search history.

(56) References Cited

U.S. PATENT DOCUMENTS 2,074,025 A * 3/1937 Porter ..... 368/260
2,538,161 A * 1/1951 Morganson ..... 368/260
2,799,334 A 7/1957 Schwab
3,349,555 A 10/1967 Georges
3,460,339 A * 8/1969 Schneider ..... 368/247
7,021,819 B2 4/2006 Schmiedchen
7,192,181 B2 3/2007 Schmiedchen
7,322,742 B2 * 1/2008 Goeller ..... 368/147

FOREIGN PATENT DOCUMENTS

CH 689 337 A5 2/1999
EP 1 429 214 A1 6/2004

OTHER PUBLICATIONS

Notice of Allowance issued in related U.S. Appl. No. 11/951,486, dated Apr. 25, 2008.
European Search Report issued in corresponding application No. EP 06 12 6041, completed Aug. 16, 2007.

* cited by examiner

*Primary Examiner*—Vit W Miska
(74) *Attorney, Agent, or Firm*—Griffin & Szipl, P.C.

(57) ABSTRACT

The timepiece includes a striking mechanism (20) which includes a mobile part (60, 70), and a time-setting mechanism (16). The time-setting mechanism (16) cooperates via a first arm (72) with the mobile part (60) of the striking mechanism (20) and via a second arm (78) with an element (30) of the time-setting mechanism (16). The time-setting mechanism includes a control member (88) whose pivoting is controlled by a time-setting lever (30). The pull-out piece (50) which causes the locking lever (24) to pivot to a locked time-setting position, when the time-setting lever (30) pivots to the time-setting position thereof and the locking lever (24) includes locking means (74) which cooperate with the striking mechanism (60) to prevent the release of the striking work in the striking work locked position.

13 Claims, 2 Drawing Sheets

TIMEPIECE WITH A STRIKING WORK INCLUDING DUAL FUNCTION LOCKING LEVER

CROSS REFERENCE TO RELATED APPLICATIONS

This application claims priority from European Patent Application No. 06126041.0 filed Dec. 13, 2006, the entire disclosure of which is incorporated herein by reference.

FIELD OF THE INVENTION

The invention concerns a timepiece with a striking work including a locking lever.

BACKGROUND OF THE INVENTION

The invention concerns more specifically a timepiece including a striking mechanism that includes a mobile part moving when the striking work is released, the timepiece further including a time-setting mechanism which cooperates with a winding stem, the time-setting mechanism including a time-setting lever that pivots between an angular rest position and an angular time-setting position, and a pull-out piece whose pivoting is controlled, by the time-setting lever, between a winding position and a time-setting position, the pull-out piece controlling the axial sliding of a sliding pinion from a winding position to a time-setting position, the timepiece including a locking lever, which cooperates, via a first arm, with the mobile part of the striking mechanism and via a second arm, with the time-setting mechanism, such that, when the mobile part moves after the striking work has been release, the locking lever pivots to a locked time-setting position wherein the time-setting mechanism is locked.

A timepiece of this type is disclosed for example in EP Patent No. 1 429 214. In this document, the pull-out piece includes a pin which is received in a notch of the locking lever, when the release lever pivots to the locked time-setting position, after the striking work has been released.

The timepiece disclosed in that document is not completely satisfactory since there is no system provided for neutralising the striking work during a time-setting operation. Consequently, there is a significant risk of some elements of the movement fitted to the timepiece being damaged or locked, in the event of poor manipulation by the user. Since the user is not always entirely familiar with the working of the timepiece and the complications thereof, it regularly occurs that ill-advised manipulations, such as releasing the striking work during a time-setting operation, are carried out despite warnings, which may require returning the timepiece to after-sales service.

SUMMARY OF THE INVENTION

It is an object of the present invention to overcome these drawbacks by providing a timepiece fitted with a simple and reliable mechanism for neutralising the striking work during time-setting.

The invention therefore proposes a timepiece of the type described above, characterized in that the time-setting mechanism includes a control member that causes the locking lever to pivot to a locked striking work position, when the time-setting lever pivots to the time-setting position and in that the locking lever includes locking means that cooperate with complementary means of the striking mechanism to prevent the latter being released, in the locked striking work position.

Owing to the timepiece according to the invention, the risk of bad manipulations by the user is prevented since the striking work cannot be released during a time-setting operation and vice versa. Moreover, the same part, the locking lever, alternately performs two functions which are locking the striking work and locking the time-setting mechanism. The proposed solution thus makes the working of the timepiece according to the invention more reliable with a minimum of parts.

According to another feature of the invention, the control member that causes the locking lever to pivot to the locked striking work position is arranged on the time-setting lever which directly connects the pivoting of the time-setting lever to the locking of the striking work without requiring an additional part to be arranged in the time-setting mechanism.

The invention is applies in particular to the case wherein the timepiece includes a release lever that releases the striking work when it is made to pivot from a rest position to a release position. Advantageously the first arm of the locking lever includes a striking work locking hook, which, in the locked striking work position, cooperates with a first locking zone arranged on the release lever so as to lock the striking mechanism. The striking work is thus locked in a simple manner, using a minimum of parts.

Preferably, the first hooking zone of the release lever includes a first control surface that cooperates with a first support surface arranged on the locking lever in order to cause the locking lever to pivot to the locked time-setting position thereof, when the release lever pivots to the release position thereof. Thus, the first hooking zone performs two functions, which are hooking with the striking work locking hook and controlling the pivoting of the locking lever to the locked time-setting position thereof.

According to an advantageous embodiment, the first hooking zone is formed by a hooking pin, which is arranged on the release lever and which is formed by the free end section of a pin secured to the release lever. This solution is particularly simple and easy to manufacture.

According to another feature of the invention, the second arm of the locking lever includes a time-setting locking hook, which, in the locked time-setting position, cooperates with a second hooking zone arranged on the time-setting lever so as to lock the time-setting mechanism. The time-setting mechanism is thus achieved in a simple manner, using a minimum of parts.

Preferably, the second hooking zone arranged on the time-setting lever includes a second control surface, which cooperates with a second support surface arranged on the time-setting locking hook so as to cause the locking lever to pivot to the second locked position thereof, when the time-setting lever pivots to the time-setting position. Thus, the second hooking zone performs two functions, which are hooking with the time-setting locking hook and controlling the pivoting of the locking lever to the locked striking work position.

According to an advantageous embodiment, the time-setting lever includes a hooking arm, which extends generally in a parallel plane to the plane of the locking lever and the second hooking zone is arranged at the free end of said hooking arm.

According to another feature of the invention, an isolating lever is provided, whose pivoting is controlled by a mobile part of the striking mechanism when the striking work is released, from an angular rest position to an angular isolating position, so as to cause the sliding pinion to slide from the winding position to an intermediate position, axially located between the winding position and the time-setting position thereof. This isolation lever prevents any winding operation occurring during the release of the striking work, in order to prevent damage to the timepiece mechanisms.

According to an advantageous embodiment, the isolation lever is biaised elastically to abut against the mobile part of the striking mechanism such that the pivoting of the mobile part when the striking work is released causes the isolating lever to pivot from the rest position to the isolating position thereof. In order to control the sliding of the sliding pinion, the isolating lever abuts against a pin secured to the pivoting free end of the pull-out piece. These features enable the isolation function to be achieved simply and reliably with a minimum of parts.

BRIEF DESCRIPTION OF THE DRAWINGS

Other features and advantages of the present invention will appear more clearly upon reading the following detailed description, made with reference to the annexed drawings, given by way of non limiting example and in which.

DETAILED DESCRIPTION OF THE PREFERRED EMBODIMENTS

In the following description, an orthogonal marking V, L, T, respectively defining the vertical, longitudinal and transverse orientations, is used in a non-limiting manner.

Figure 1:
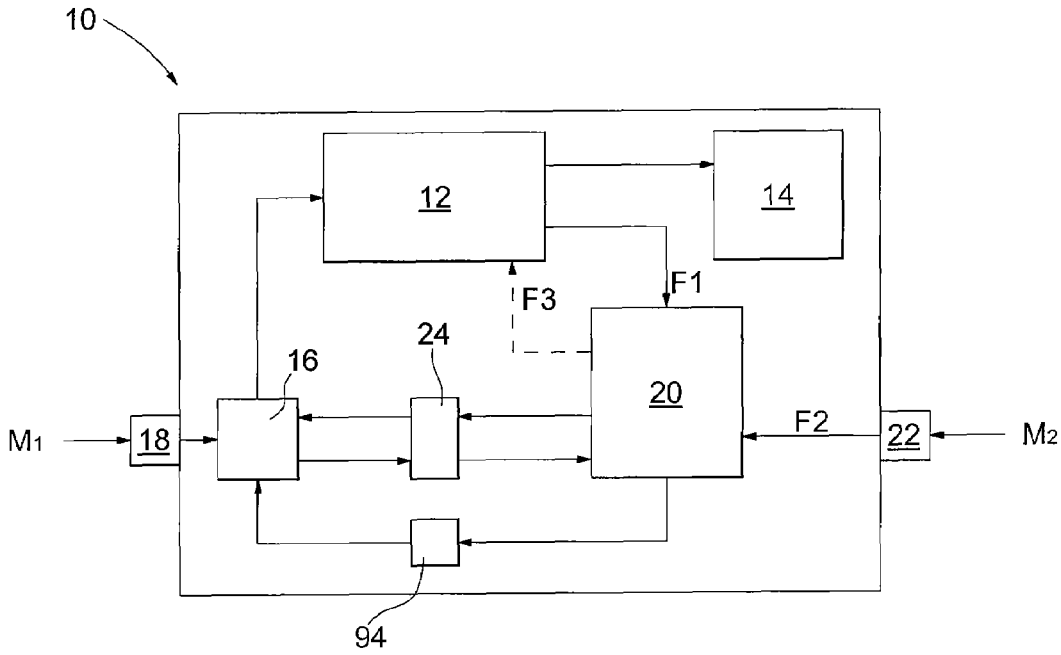
FIG. 1 is an operating diagram that shows the main elements of the timepiece according to the invention.

FIG. 1 shows a timepiece 10, such as a wristwatch. This timepiece 10 is fitted with a mechanical timepiece movement 12 controlling a display device 14 generally formed by hands.

Timepiece 10 also includes a time-setting mechanism 16, which is able to cooperate with timepiece movement 12 to change the time indicated by display device 14. Time-setting mechanism 16 is controlled by a first manual control member, such as a winding crown 18, on which a user can act manually M1.

Timepiece 10 further includes a striking mechanism 20, which can be released here, either automatically by timepiece movement 12, which is represented by arrow F1, or manually M2 via a second manual control member 22, which is represented by arrow F2. When the striking work is released, striking mechanism 20 will search in movement 12 for the information concerning the number of blows to strike, which is represented by arrow F3.

A locking lever 24 is inserted between the time-setting mechanism 16 and the striking mechanism 20 so as to prevent the use of time-setting mechanism 16 during release of the striking work.

According to a feature of the invention, locking lever 24 is also provided for locking striking mechanism 20 during a time-setting operation.

Time-setting mechanism 16, striking mechanism 20 and locking lever 24 will now be described in more detail with reference to FIGS. 2 to 4.

Figure 2:
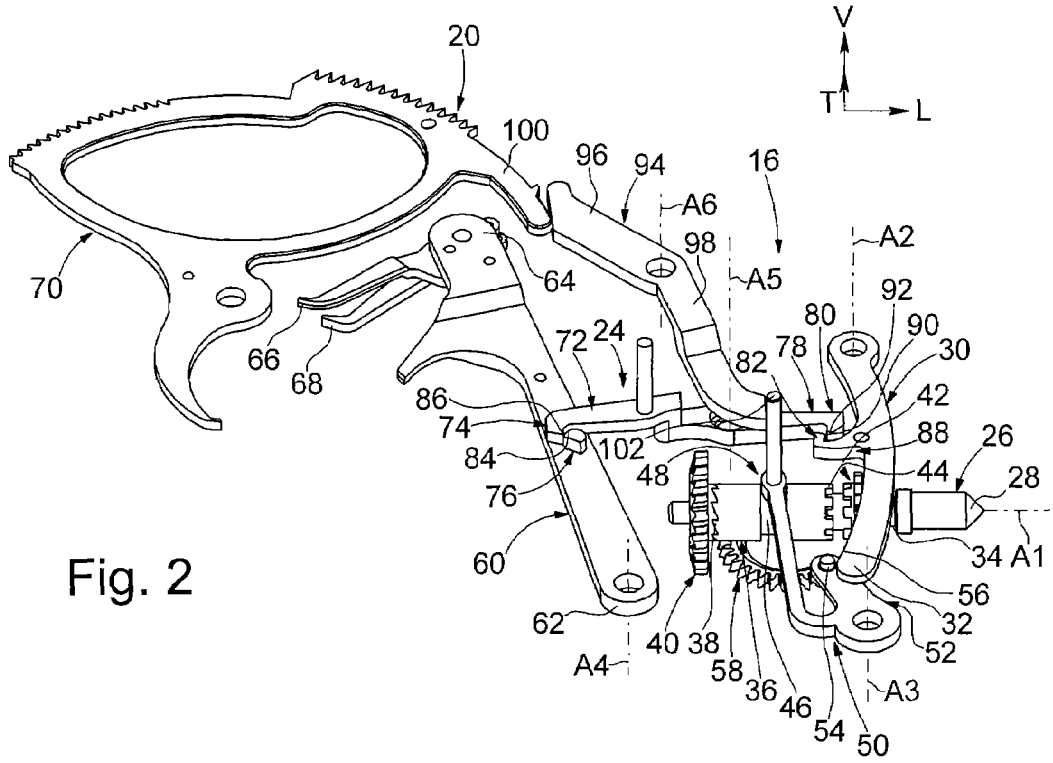
FIG. 2 is a perspective view that shows schematically the time-setting mechanism and one part of the striking mechanism of the timepiece of FIG. 1 in the rest state corresponding to a winding configuration.

Time-setting mechanism 16 includes a winding stem 26 sliding along a longitudinal axis A1 oriented, in a non-limiting manner, from the interior outwards, which corresponds to a left to right orientation in FIG. 2. Winding crown 18 is provided to be secured to the outer axial end 28 of winding stem 26 so as to allow the user, on the one hand, to control the rotation of winding stem 26 about its axis A1 and, on the other hand, to control the axial sliding (A1) of winding stem 26 between an axial winding position P0 which is shown in FIG. 2, and an axial time-setting position P1, which is shown in FIG. 3.

In the following description, the aforementioned pivoting axes are substantially vertical unless otherwise indicated.

The pivoting of a time-setting lever 30, which extends overall along a transverse direction above winding stem 26, is controlled by sliding winding stem 26. Time-setting lever 30 pivots about a fixed arbour A2, on the opposite side to the free end 32 thereof, and it is hinged in a groove 34 arranged in winding stem 26. Time-setting lever 30 pivots between an angular rest position $PA_{rep}$, which is shown in FIG. 2, and an angular time-setting position $PA_{mah}$, which is shown in FIG. 3.

A sliding pinion 36, which is coaxial and secured in rotation to winding stem 26, is guided as it slides longitudinally on winding stem 26 between a winding position $P_{rem}$, wherein the inner end 38 thereof meshes with a winding pinion 40 coaxial to winding stem 26, and a time-setting position $P_{mah}$, wherein the outer end 42 thereof meshes with a time-setting pinion 44 coaxial to winding stem 26. Sliding pinion 36 meshes here with winding pinion 40 via a toothing with wolf teeth and with time-setting pinion 44 via a square shaped toothing. Winding pinion 40 and time-setting pinion 44 are mounted to rotate freely on winding stem 26, sliding pinion 36 being used to connect one or other of the two pinions 40, 44 in rotation with winding stem 26.

The intermediate section of sliding pinion 36 is provided with an annular peripheral groove 46 which is provided for receiving the hinged free end 48 of a pull-out piece 50, which extends overall along a transverse direction above winding stem 26. Pull-out piece 50 pivots about a fixed arbour A3 and includes a control arm 52 fitted with a pin 54 which is biaised elastically to abut against an inner surface 56 arranged in the free end 32 of time-setting lever 30. The means that biais pull-out piece 50 elastically against time-setting lever 30 are not shown here but they could take any suitable form, such as the form of an elastic tongue. Pull-out piece 50 pivots between an angular winding position $PA_{rem}$, which corresponds to the winding position $P_{rem}$ of sliding pinion 36, and an angular time-setting position $PA_{mah}$, which corresponds to the time-setting position $P_{mah}$ of sliding pinion 36.

Thus, the pivoting of time-setting lever 30 to the time-setting position $PA_{mah}$ thereof, causes pull-out piece 50 to pivot to its own time-setting position $PA_{mah}$. This pivoting of pull-out piece 50 drives sliding pinion 36 towards its own axial time-setting position $P_{mah}$, via the free end 48 of pull-out piece 50.

Time-setting pinion 44 meshes with a time-setting wheel 58 which extends here in a horizontal plane, underneath winding stem 26, and which meshes in a known manner with a gear train of timepiece movement 12.

Figure 3:
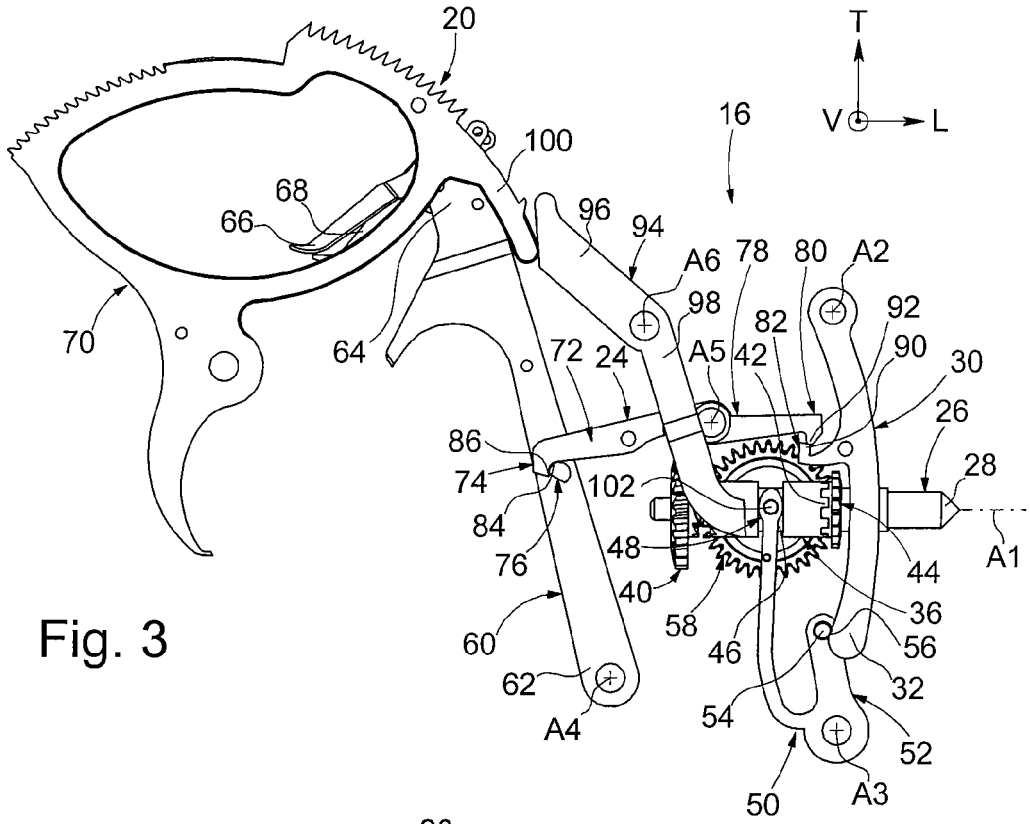
FIG. 3 is a top view that shows schematically the mechanisms of FIG. 2 when the time-setting mechanism is in the operating state and when the striking mechanism is in the locked state.
Figure 4:
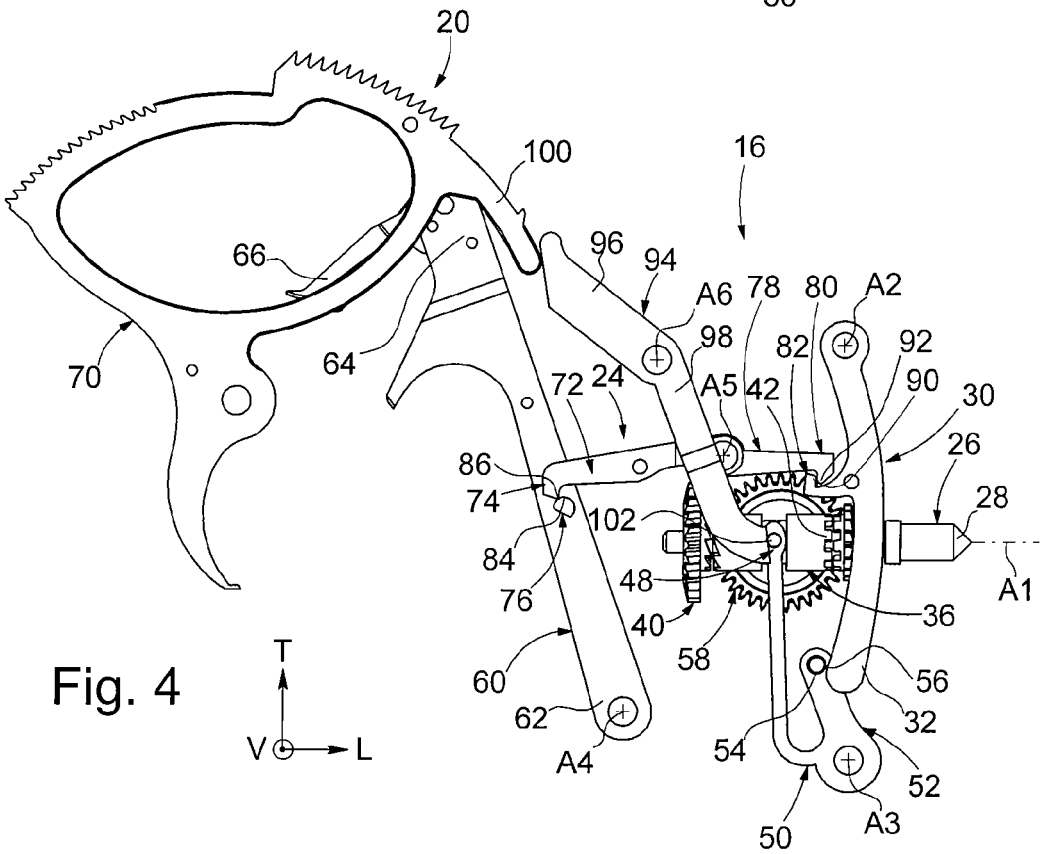
FIG. 4 is a similar view to that of FIG. 3, showing the mechanisms of FIG. 2 when the time-setting mechanism is in the locked state and the striking mechanism is released.

FIGS. 2 to 4 show only those parts of striking mechanism 20 that are necessary for comprehension of the invention.

Striking mechanism 20 includes a first mobile part formed by a release lever 60 which includes a first end 62 pivotably mounted about a fixed arbour A4 and a second free end 64, which here carries two clicks 66, 68 provided for cooperating with the gear train of striking mechanism 20 so as to release the same, when release lever 60 pivots from the angular rest position $P_i$ thereof, which is shown in FIGS. 2 and 3, to the angular release position $P_{ii}$ thereof, which is shown in FIG. 4.

Striking mechanism 20 includes a second mobile part formed by a minute rack 70, which pivots when the striking work is released, after release lever 60 has pivoted, so as to determine the number of blows to strike.

In accordance with an advantageous feature of the invention, the locking lever 24 is pivotably mounted about a fixed arbour A5 between a locked striking work position $P_{sv}$, which is shown in FIG. 3, and a locked time-setting position Pmahv, which is shown in FIG. 4. Locking lever 24 also includes an intermediate angular rest position $P_{rep}$, which is shown in FIG. 2, wherein neither the striking work, nor the time-setting mechanism is locked. Preferably, locking lever 24 includes an elastic element such as a spring (not shown) which returns the latter to the intermediate rest position $P_{rep}$.

According to the embodiment shown, locking lever 24 includes, on either side of the pivoting axis A5 thereof, a first arm 72 whose free end forms a striking work locking hook 74, which cooperates with a first hooking zone 78 arranged on release lever 60, and a second arm 78 whose free end forms a time-setting locking hook 80 which cooperates with a second hooking zone 82 arranged on time-setting lever 30.

Advantageously, the first hooking zone 76 includes a first control surface 84, which cooperates with a first associated support surface 86 arranged on locking lever 24 so as to cause locking lever to pivot to the locked time-setting position $P_{mahv}$, when release lever 60 pivots to the release position $P_{ii}$.

Preferably, a hooking pin 76 which is arranged on release lever 60 forms the first hooking zone 76 and the control surface 84 is formed by a cylindrical axial wall of hooking pin 76. Locking pin 76 is formed here by the free end section of a pin driven into release lever 60. The first support surface 86 is preferably formed by the free end of striking work locking hook 74.

Advantageously, time-setting lever 30 includes a hooking arm 88, which extends overall in a parallel plane to the plane of locking lever 24. The free end of hooking arm 88 has the shape of a hook and it forms the second hooking zone 82.

Preferably, the second hooking zone 82 includes a second control surface 90, which cooperates with a second support surface 92 arranged on time-setting locking hook 80 so as to cause locking lever 24 to pivot to the time-setting position $P_{sv}$, when time-setting lever 30 pivots to time-setting position $PA_{mah}$. The free end of time-setting locking hook 80 forms the second support surface 92 here.

Hooking arm 88 here forms a control member able to cause locking lever 24 to pivot to the striking work locked position $P_{sv}$.

According to another feature of the invention, timepiece 10 is fitted with an isolating lever 94 which will place sliding pinion 36 in an intermediate axial position $P_{int}$, between the winding position $P_{rem}$ and time-setting position $P_{man}$, when the striking work is released, so as to prevent timepiece movement 12 from being wound. Indeed, performing a winding operation during the operation of striking mechanism 20 could damage the elements of striking mechanism 20 or elements of timepiece movement 12. This winding operation could also produce an acceleration effect in the acoustic effect of the striking work, when the operation acts on a barrel used for the striking work, which is detrimental to the striking work quality.

Therefore, the pivoting of isolating lever 94 about a fixed arbour A6 is controlled by a mobile part of striking mechanism 20 when the striking work is released, from an angular rest position $P_a$, which is shown in FIGS. 2 and 3, to an angular isolating position $P_b$, which is shown in FIG. 4. More specifically, isolating lever 94 includes a control arm 96 and an isolating arm 98, control arm 96 being biaised elastically to abut against a support arm 100 of minute rack 70 such that, when a striking work is released, the pivoting of minute rack 70 causes the isolating lever to pivot to the isolating position $P_b$ thereof.

When isolating lever 94 pivots from the rest position $P_a$ to the isolating position $P_b$ thereof, isolating arm 98 abuts against a pin 102 pivotably linked to the free end 48 of pull-out piece 50 so as to cause pull-out piece 50 to pivot about the axis A3 thereof, to an intermediate angular position corresponding to the intermediate axial position $P_{int}$ of sliding pinion 36, this position being illustrated in FIG. 4. Pin 102 is for example driven into the free end 48 of pull-out piece 50.

It will be noted that the pivoting of pull-out piece 50 to the intermediate angular position occurs here against the elastic return force by pin 54 that holds it abutting against time-setting lever 30.

We will now describe the operation of locking lever 24 and isolating lever 94 according to the invention from the rest configuration shown in FIG. 2.

In FIG. 2, time-setting mechanism 16 is in a configuration suitable for winding timepiece movement 12. The user can therefore move winding stem 26 in rotation about the axis A1 thereof, by using winding crown 22, which causes the rotation of winding pinion 40 via sliding pinion 36, the latter occupying the axial winding position $P_{rem}$.

In order to set the time, the user slides winding stem 26 outwards to the time-setting position P1, which causes time-setting lever 30 to slide from the rest position $PA_{rep}$ to the time-setting position $PA_{mah}$, as shown in FIG. 3.

The pivoting of time-setting lever 30 causes pull-out piece 50 to pivot, which drives sliding pinion 36, via the free end 48, to the time-setting position $P_{mah}$, where it meshes with time-setting pinion 44. Simultaneously, as hooking arm 88 moves outwards with time-setting lever 30, the second control surface 90 of hooking arm 88 cooperates with the second support surface 92, pushing back time-setting locking hook 80 to cause locking lever 24 to pivot, here in the anticlockwise direction.

When time-setting lever 30 has finished pivoting, locking lever 24 occupies the striking work locked position $P_{sv}$, striking work locking hook 74 cooperating with hooking pin 76 to block release lever 60 from pivoting, which prevents the striking work being released.

At the end of the time-setting operation, the user pushes back winding stem 26 to winding position P0, such that all of the mobile parts return to their initial positions shown in FIG. 2.

When the striking work is released, either automatically, or manually, release lever 60 pivots to the angular release position thereof. $P_i$, as shown in FIG. 4. This pivoting causes, via the first control surface 84 of hooking pin 76, which cooperates with the second support surface 86, locking lever 24 to pivot to the locked time-setting position $P_{mahv}$. In this second locked time-setting position $P_{mahv}$, time-setting locking hook 80 cooperates with the second hooking zone 82 of hooking arm 88 to block time-setting lever 30 from pivoting, which prevents any time-setting operation.

Simultaneously, during release of the striking work, the pivoting of minute rack 70 causes isolating lever 94 to pivot to the isolating position $P_b$ which, via pin 102 and pull-out piece 50, causes sliding pinion 36 to slide to the intermediate position $P_{int}$ thereof, to prevent any winding operation during the strike.

At the end of the strike, release lever 60 returns to the initial angular rest position $P_i$, such that all of the mobile parts return to their initial positions shown in FIG. 2.

According to an alternative embodiment (not shown), the pivoting of locking lever 24 to the locked time-setting position $P_{mahv}$ could be controlled by the pivoting of minute rack 70. In such case, the first arm 72 of locking lever 24 cooperates, directly or via an intermediate part, with a portion of minute rack 70.

Likewise, the pivoting of release lever 60 could control the pivoting of isolating lever 94 to the isolating position $P_b$. In such case, the control arm 96 of isolating lever 94 cooperates, directly or via an intermediate part, with a portion of release lever 60.

According to another variant (not shown), time-setting mechanism 16 could take a different form, in particular the mechanical connections between time-setting lever 30, pull-out piece 50, sliding pinion 36, and winding stem 26 could be achieved in a different manner, relative to the embodiment described with reference to the Figures.

What is claimed is:

1. A timepiece including a striking mechanism with a striking work which includes a mobile part moving when the striking work is released, the timepiece further including a time-setting mechanism which cooperates with a winding stem, the time-setting mechanism including a time-setting lever, which pivots between an angular rest position and an angular time-setting position, and a pull-out piece, whose pivoting is controlled by the time-setting lever, between a winding position and a time-setting position, the pull-out piece controlling the axial sliding of a sliding pinion from a winding position to a time-setting position, the timepiece including a locking lever, which cooperates, via a first arm with the mobile part of the striking mechanism and via a second arm with an element of the time-setting mechanism such that, when the mobile part moves after the striking work has been released, the locking lever pivots to a locked time-setting position wherein the time-setting mechanism is locked, wherein the time-setting lever includes a control member that causes the locking lever to pivot to a locked striking work position, when the time-setting lever pivots to the time-setting position and wherein the locking lever includes locking means that cooperate with complementary means of the striking mechanism to prevent the release thereof, in the locked striking work position.

2. The timepiece according to claim 1, wherein the control member which causes the locking lever to pivot to the locked striking work position thereof is arranged on the time-setting lever.

3. The timepiece according to claim 1, wherein the striking mechanism includes a release lever which releases the striking work when it is made to pivot from a rest position to a release position, and wherein the first arm of the locking lever includes a striking work locking hook, which, in the locked striking work position, cooperates with a first hooking zone arranged on the release lever so as to lock the striking mechanism.

4. The timepiece according to claim 3, wherein the first hooking zone of the release lever includes a first control surface, which cooperates with a first support surface arranged on the locking lever so as to cause the locking lever to pivot to the locked time-setting position when the release lever pivots to the release position thereof.

5. The timepiece according to claim 3, wherein the first hooking zone is formed by a hooking pin which is arranged on the release lever.

6. The timepiece according to claim 5, wherein the hooking pin is formed by the free end section of a pin secured in the release lever.

7. The timepiece according to claim 1, wherein the second arm of the locking lever includes a time-setting locking hook, which, in the locked time-setting position, cooperates with a second hooking zone arranged on the time-setting lever so as to lock the time-setting function.

8. The timepiece according to claim 7, wherein the second hooking zone arranged on the time-setting lever includes a second control surface which cooperates with a second support surface arranged on the time-setting locking hook so as to cause the locking lever to pivot to the locked striking work position when the time-setting lever pivot to the time-setting position ($PA_{mah}$) thereof.

9. The timepiece according to claim 7, wherein the time-setting lever includes a hooking arm which extends overall in a parallel plane to the plane of the locking lever and wherein the second hooking zone is arranged at the free end of said hooking arm.

10. The timepiece according to claim 1, wherein there is provided an isolating lever, whose pivoting is controlled by a mobile part of the striking mechanism when the striking work is released, from an angular rest position to an angular isolating position, so as to cause the sliding pinion to slide from the winding position thereof to an intermediate position, axially located between the winding position and the time-setting position thereof.

11. The timepiece according to claim 10, wherein the isolating lever is biaised elastically to abut against the mobile part of the striking mechanism such that the pivoting of the mobile part when the striking work is released, causes the isolating lever to pivot from the rest position to the isolating position thereof.

12. The timepiece according to claim 11, wherein, in order to control the pivoting of the sliding pinion, the isolating lever abuts against a pin secured to the pivoting free end of the pull-out piece.

13. The timepiece according to claim 2, wherein the striking mechanism includes a release lever which releases the striking work when it is made to pivot from a rest position to a release position, and wherein the first arm of the locking lever includes a striking work locking hook, which, in the locked striking work position, cooperates with a first hooking zone arranged on the release lever so as to lock the striking mechanism.

* * * * *